US006415111B1

(12) United States Patent
Higeta

(10) Patent No.: US 6,415,111 B1
(45) Date of Patent: Jul. 2, 2002

(54) PROCESS CARTRIDGE AND IMAGE FORMING APPARATUS HAVING PROCESS CARTRIDGE THAT HAS A PLURALITY OF MEASURING ELECTRODE MEMBERS

(75) Inventor: Akira Higeta, Funabashi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/695,058

(22) Filed: Oct. 25, 2000

(30) Foreign Application Priority Data

Oct. 27, 1999 (JP) ..... 11-306058

(51) Int. Cl.[7] ..... G03G 15/08
(52) U.S. Cl. ..... 399/27
(58) Field of Search ..... 399/24, 27, 61; 118/694

(56) References Cited

U.S. PATENT DOCUMENTS

| | | | |
|---|---|---|---|
| 5,331,373 A | 7/1994 | Nomura et al. | |
| 5,452,056 A | 9/1995 | Nomura et al. | |
| 5,485,249 A | 1/1996 | Higeta et al. | |
| 5,585,889 A | 12/1996 | Shishido et al. | |
| 5,740,499 A | 4/1998 | Higeta et al. | 399/105 |
| 5,809,374 A | 9/1998 | Tsuda et al. | 399/111 |
| 6,101,348 A | 8/2000 | Nonaka et al. | 399/103 |
| 6,185,390 B1 | 2/2001 | Higeta et al. | 399/90 |
| 6,253,036 B1 * | 6/2001 | Karakama et al. | 399/27 |

FOREIGN PATENT DOCUMENTS

| | | |
|---|---|---|
| JP | 5-100571 | 4/1993 |
| JP | 2000-122397 | 4/2000 |
| JP | 2000-122398 | 4/2000 |

* cited by examiner

*Primary Examiner*—William J. Royer
(74) *Attorney, Agent, or Firm*—Fitzpatrick, Cella, Harper & Scinto

(57) ABSTRACT

A process cartridge detachably mountable to a main body of an electrophotographic image forming apparatus includes an electrophotographic photosensitive member, a process device acting on the member, a developer container for containing developer, and a plurality of measuring electrode members. The plurality of measuring electrode members are disposed at a location capable of contacting the developer and include input side and output side electrodes having at least one pair of portions juxtaposed with a predetermined interval therebetween. The interval between the juxtaposed portions of the input side and output side electrodes is different for every measuring electrode member. The cartridge also includes a plurality of measuring electrode output contacts electrically connected to the output side electrodes of the plurality of measuring electrode members, and a common input contact electrically connected to the input side electrodes of the plurality of measuring electrode members.

13 Claims, 14 Drawing Sheets

PROCESS CARTRIDGE AND IMAGE FORMING APPARATUS HAVING PROCESS CARTRIDGE THAT HAS A PLURALITY OF MEASURING ELECTRODE MEMBERS

BACKGROUND OF THE INVENTION

1. Field of the Invention

The present invention relates to a process cartridge and an electrophotographic image forming apparatus to which the process cartridge is detachably mountable.

Here, the electrophotographic image forming apparatus may be, for example, an electrophotographic copying machine, an electrophotographic printer (for example, LED printer, laser beam printer or the like), an electrophotographic facsimile, an electrophotographic word processor, or the like.

Further, the process cartridge may incorporate therein an electrophotographic photosensitive member and at least one of charging means, developing means and cleaning means as a cartridge unit which can be detachably mounted to a main body of the image forming apparatus or may incorporate therein an electrophotographic photosensitive member and at least developing means as a cartridge unit which can be detachably mounted to a main body of the image forming apparatus.

2. Related Background Art

In conventional electrophotographic image forming apparatuses using an electrophotographic image forming process, a process cartridge in which an electrophotographic photosensitive member and process means acting on the electrophotographic photosensitive member are integrally incorporated as a cartridge unit which can be detachably mounted to a main body of the image forming apparatus has been utilized. According to the process cartridge system, since maintenance of the apparatus can be performed by the user without any expert, operability can be improved considerably. Thus, the process cartridge system has widely been used in the electrophotographic image forming apparatus.

Among such electrophotographic image forming apparatuses of the process cartridge type, there is an image forming apparatus including means for informing the user of the fact that developer is depleted, i.e., a developer amount detecting device.

As the developer amount detecting device, a device in which two electrode rods are disposed within a developer container of developing means and a developer amount is detected by detecting a change in capacitance between the two electrode rods is known.

Further, Japanese Patent Application Laid-Open No. 5-100571 discloses a developer amount detecting device comprising, in place of two electrode rods, a developer detecting electrode member obtained by combining two parallel electrodes interdigitated with each other on the same plane with a predetermined distance therebetween and in which the developer detecting electrode member is located on a lower surface of a developer container. This device serves to detect a developer remaining amount by detecting a change in capacitance between the parallel electrodes in a flat plane.

However, both of the above-mentioned developer amount detecting devices detect the presence and absence of the developer in the developer container, i.e., detect that the amount of the developer is small immediately before the developer in the developer container is depleted, but do not detect how much developer remains in the developer container.

On the other hand, if the developer remaining amount in the developer container can be detected stepwise, the user can know or recognize the developer using state in the developer container, with the result that a new process cartridge can be prepared in accordance with the exchanging time. This is very convenient for the user.

SUMMARY OF THE INVENTION

An object of the present invention is to provide a process cartridge and an electrophotographic image forming apparatus, in which a developer remaining amount can be detected successively.

Another object of the present invention is to provide a process cartridge and an electrophotographic image forming apparatus, in which a developer remaining amount can be detected stepwise in accordance with the consumption of the developer in a developer container constituting a developer containing portion.

A further object of the present invention is to provide a process cartridge and an electrophotographic image forming apparatus, which includes a developer amount detecting device having less detection error by eliminating the measurement error caused by a change in environment when a developer remaining amount is detected by detecting a change in capacitance between electrodes and in which user's convenience in usage of the apparatus is improved.

A still further object of the present invention is to provide a process cartridge and an electrophotographic image forming apparatus, in which distances between juxtaposed portions of input and output electrodes of a plurality of measuring electrode members are different from a measuring electrode member to a measuring electrode member.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Figure 16:
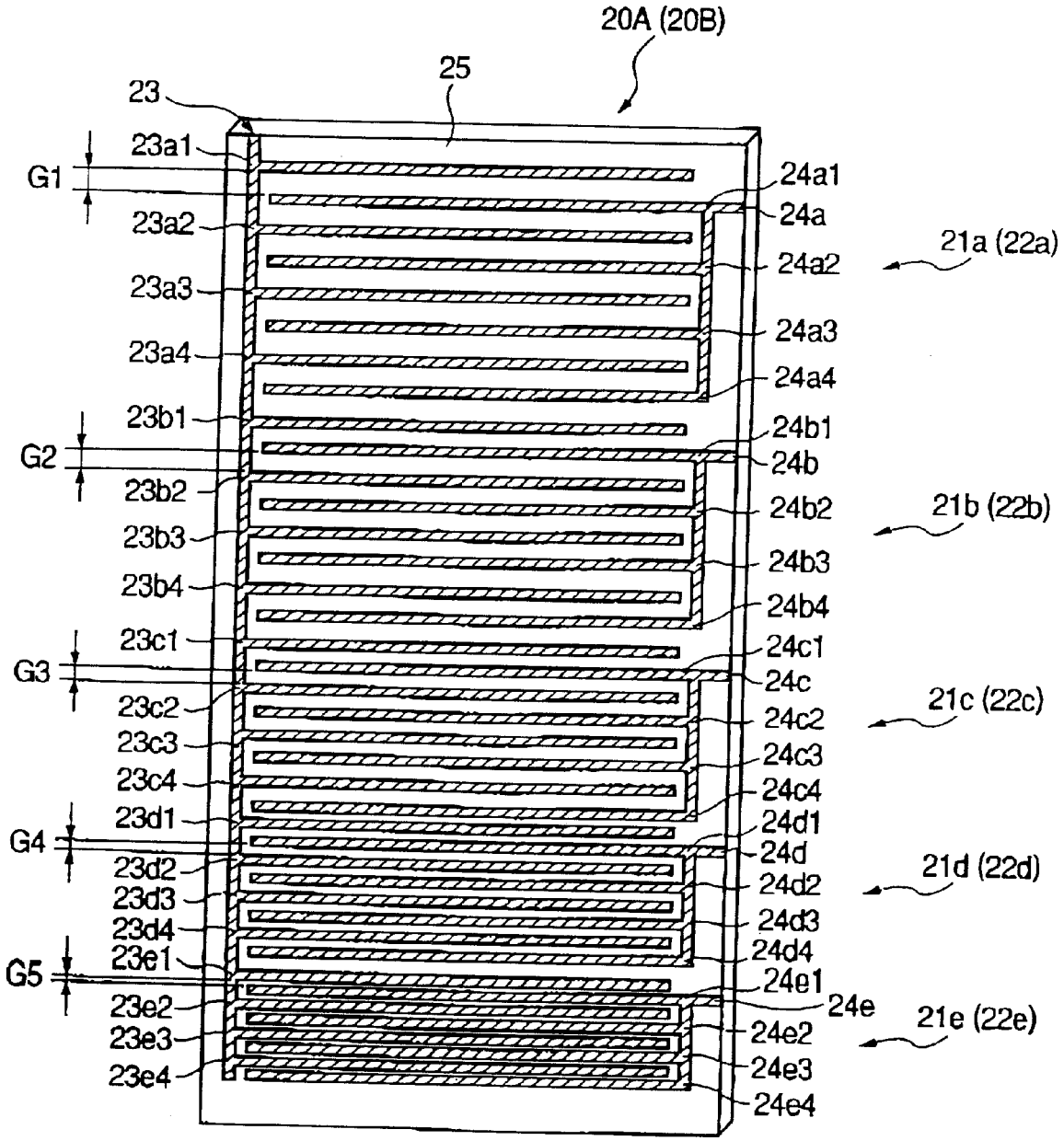
FIG. 16 is a view for explaining an embodiment of a wiring pattern for a plurality of measuring electrode members and reference electrode members included in a detecting member and a comparative member to which the present invention is applied.

Now, a process cartridge and an electrophotographic image forming apparatus according to the present invention will be fully explained with reference to the accompanying drawings. Incidentally, an embodiment according to the present invention is shown in FIG. 16

Figure 1:
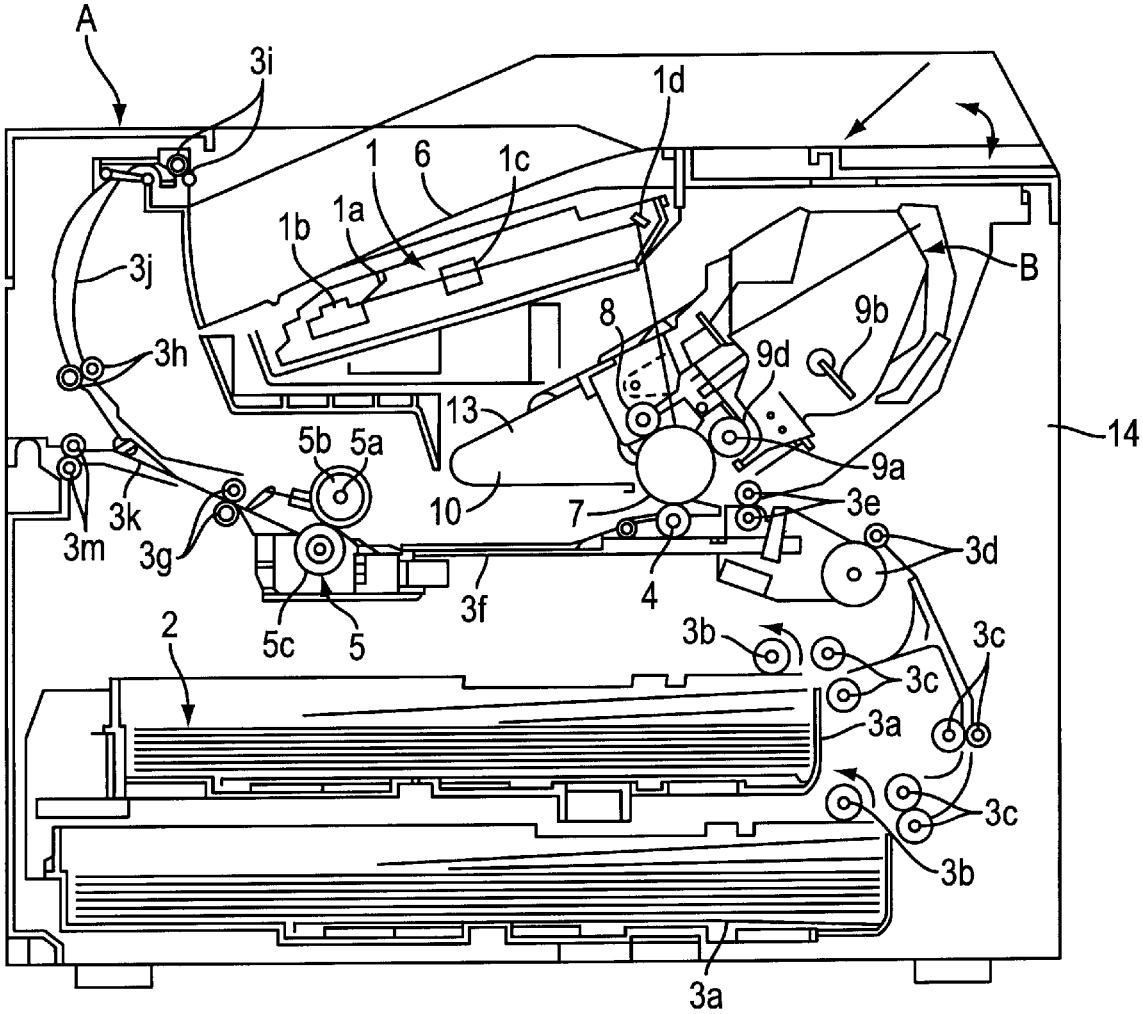
FIG. 1 is a schematic constructural view of an embodiment of an electrophotographic image forming apparatus.
Figure 2:
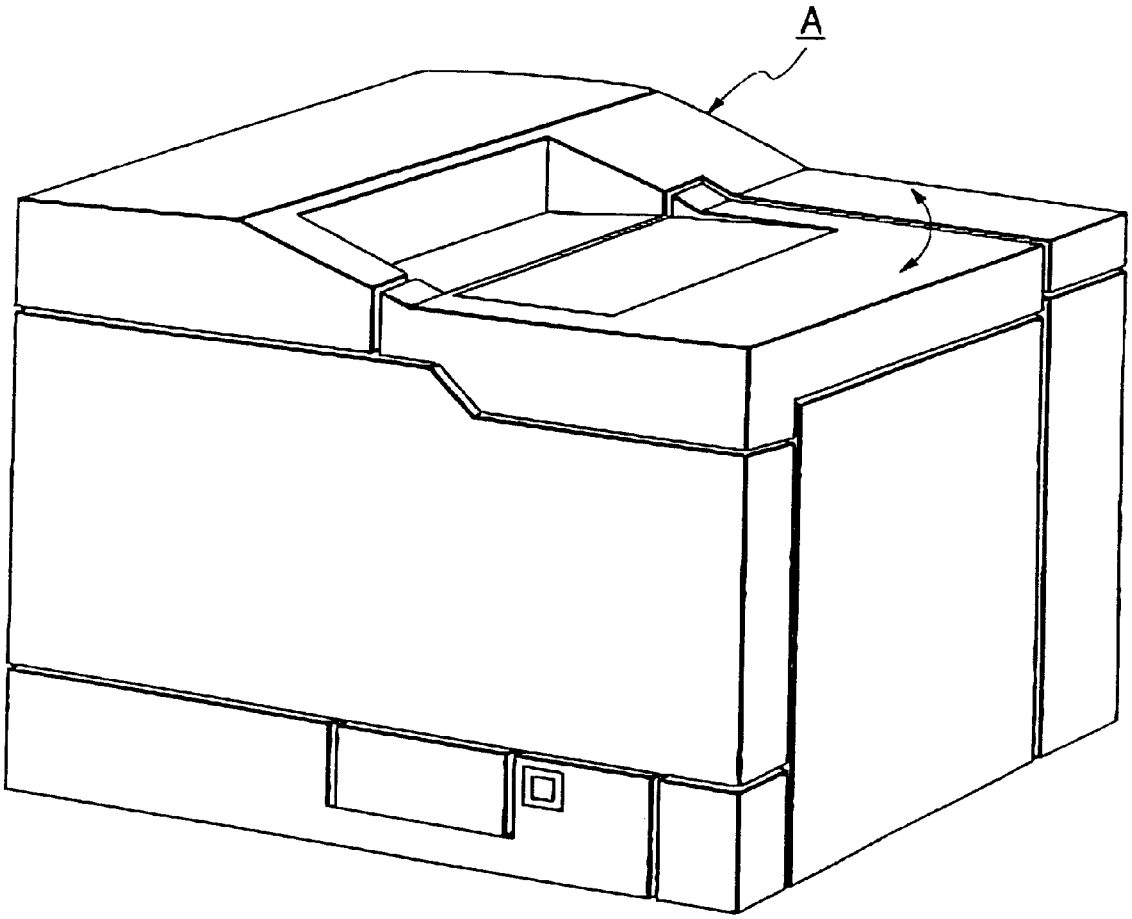
FIG. 2 is a perspective view of the electrophotographic image forming apparatus.

First of all, an embodiment of an electrophotographic image forming apparatus to which a process cartridge constructed according to the present invention is mountable will be described with reference to FIGS. 1 to 3. In this embodiment, the electrophotographic image forming apparatus is embodied as a laser beam printer A of an electrophotographic type which serves to form an image on a recording medium such as a recording paper, an OHP sheet or cloth by an electrophotographic image forming process.

The laser beam printer A includes a drum-shaped electrophotographic photosensitive member, i.e., a photosensitive drum 7. An electrostatic latent image is formed on the photosensitive drum 7 by electrostatic latent image forming means. Namely, a surface of the photosensitive drum 7 is charged by charging roller 8 as charging means, and then, a latent image corresponding to image information is formed on the photosensitive drum by illuminating a laser beam corresponding to the image information from optical means 1 including a laser diode 1*a*, a polygon mirror 1*b*, a lens 1*c* and a reflection mirror 1*d* onto the photosensitive drum. The latent image is developed by developing means 9 as a visible image, i.e, a toner image.

The developing means 9 includes a developing chamber 9A having a developing roller 9*a* as a developer bearing member. Developer in a developer container 11A as a developer containing portion formed adjacent to the developing chamber 9A is fed out to the developing roller 9*a* in the developing chamber 9A by rotation of a developer feeding member 9*b*. The developing chamber 9A is provided with a developer agitating member 9*e* disposed in the vicinity of the developing roller 9*a*, which developer agitating member serves to circulate the developer in the developing chamber. Further, the developing roller 9*a* includes a stationary magnet 9*c* therein, and, by rotating the developing roller 9*a*, the developer is carried; meanwhile, triboelectrification charge is applied to the developer by a developing blade 9*d* and a developer layer having a predetermined thickness is formed, which layer is in turn supplied to a developing area of the photosensitive drum 7. The developer supplied to the developing area is transferred onto the latent image on the photosensitive drum 7, thereby forming the toner image. The developing roller 9*a* is connected to a developing bias circuit so that developing bias obtained by superimposing DC voltage on AC voltage is normally applied to the developing roller.

On the other hand, in synchronism with the formation of the toner image, a recording medium 2 set in a sheet feeding cassette 3a is conveyed to a transfer position by a pick-up roller 3*b*, pairs of conveying rollers 3*c*, 3*d* and a pair of registration rollers 3*e*. A transfer roller 4 as transfer means is disposed at a transfer position, so that by applying voltage to the transfer roller, the toner image on the photosensitive drum 7 is transferred onto the recording medium 2.

The recording medium 2 to which the toner image was transferred is conveyed to fixing means 5 by a conveying guide 3*f*. The fixing means 5 includes a drive roller 5*c*, and a fixing roller 5*b* having a heater 5*a* therein. While the recording medium 2 is being passed through the fixing means, by applying heat and pressure to the recording medium 2, the transferred toner image is fixed onto the recording medium 2.

The recording medium 2 is conveyed by pairs of discharge rollers 3*g*, 3*h*, 3*i* and is discharged onto a discharge tray 6 through a surface reverse path 3*j*. The discharge tray 6 is provided on an upper surface of a main body 14 of the laser beam printer A. Incidentally, by operating a rockable flapper 3*k*, the recording medium 2 can be discharged by a pair of discharge rollers 3*m* without passing through the surface reverse path 3*j*. In the illustrated embodiment, the pick-up roller 3*b*, pairs of conveying rollers 3*c*, 3*d*, a pair of registration rollers 3*e*, a conveying guide 3*f*, pairs of discharge rollers 3*g*, 3*h*, 3*i*, and a pair of discharge rollers 3*m* constitute conveying means.

After the toner image was transferred to the recording medium 2 by the transfer roller 4, developer remaining on the photosensitive drum 7 is removed by cleaning means 10, for a preparation for the next image forming process. In the cleaning means 10, the residual developer on the photosensitive drum 7 is scraped off by an elastic cleaning blade 10*a* abutting against the photosensitive drum 7, and the scraped developer is collected into a waste developer reservoir 10*b*.

Figure 3:
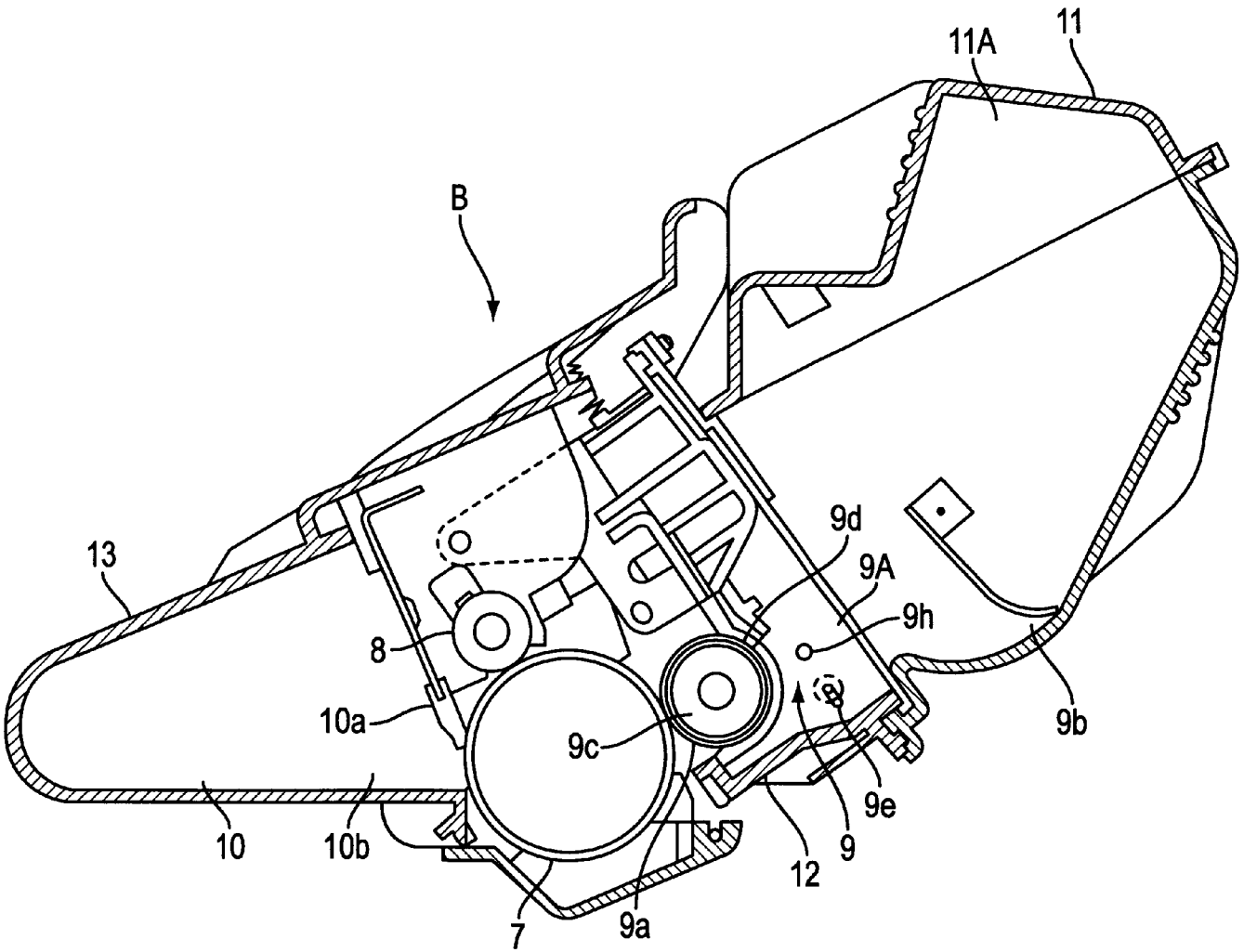
FIG. 3 is a longitudinal sectional view of a process cartridge according to an embodiment.

On the other hand, in the illustrated embodiment, as shown in FIG. 3, in a process cartridge B, a developing unit is formed by integrally welding a developer frame 11 having the developer container (developer containing portion) 11A containing the developer and the developer feeding member 9*b* to a developing frame 12 holding the developing means 9 such as the developing roller 9*a* and the developing blade 9*d*, and the cartridge is formed by integrally joining the developing unit to a cleaning frame 13 to which the photosensitive drum 7, the cleaning means 10 such as the cleaning blade 10*a*, and the charging roller 8 are attached.

The process cartridge B is detachably mounted to cartridge mounting means provided in the main body 14 of the image forming apparatus by the user. According to the illustrated embodiment, the cartridge mounting means are constituted by guide means 13R (13L) (FIG. 4) formed on both outer side surfaces of the process cartridge B, and guide portions 16R (16L) (FIG. 5) which are formed on the main body 14 of the apparatus and into which the guide means 13P (13L) can be inserted.

According to the illustrated embodiment, the process cartridge B is provided with a developer amount detecting device for stepwise detecting a remaining amount of the developer as the developer in the developing container 11A is consumed.

Figure 6:
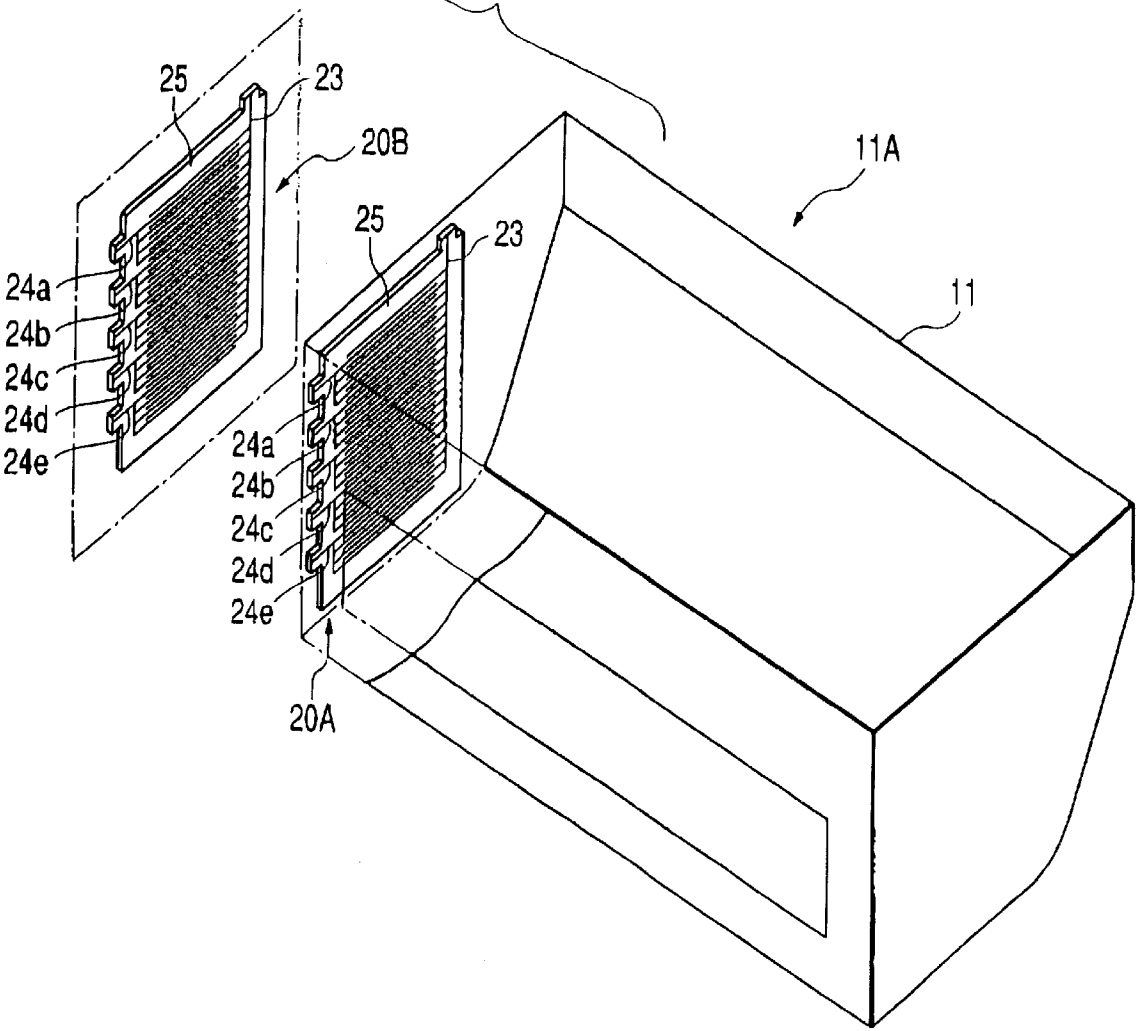
FIG. 6 is a perspective view of a developer container, for explaining a developer amount detecting device.

According to the illustrated embodiment, as shown in FIG. 6, the developer amount detecting device has a detecting member 20A for measuring the amount of the developer as a measuring part for measuring the remaining amount of the developer contained in the developer container 11A, and a comparative member 20B for detecting the environment, i.e., an atmospheric temperature and humidity, and for outputting a reference signal.

Incidentally, in the illustrated embodiment, while an example that the comparative member 20B for reference is provided was explained, the present invention is not limited to such an example, but, in order to achieve the main object of the present invention, i.e., the object for detecting the developer remaining amount stepwise, it should be noted that the comparative member 20B is not an essential element.

Figure 18:
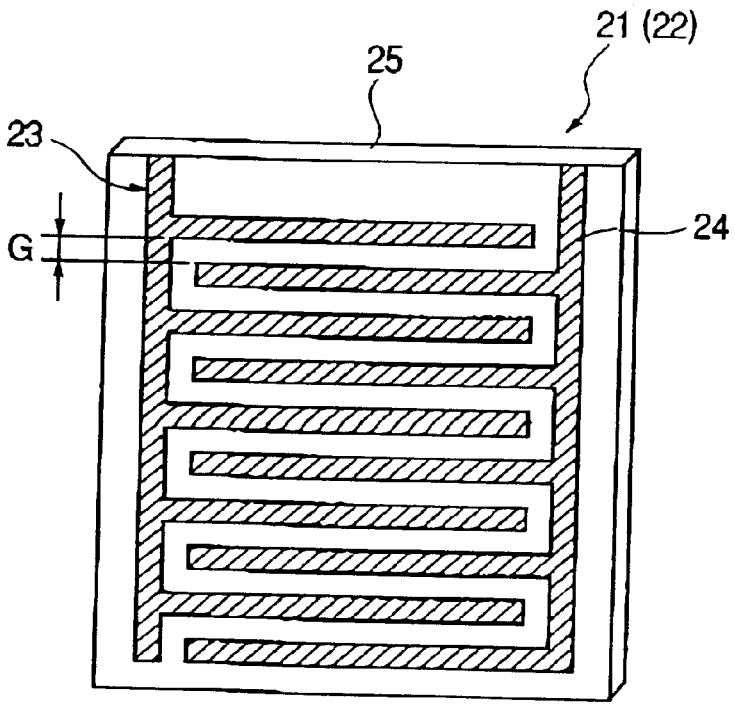
FIG. 18 is a front view showing a single measuring electrode member or a single reference electrode member.

According to the illustrated embodiment, as shown in FIG. 18, for example, the detecting member 20A and the comparative member 20B of the developer amount detecting device are constituted by a plurality of measuring electrode members 21 each comprising a pair of input side electrodes 23 and output side electrodes 24 which are juxtaposed on a substrate 25 with a predetermined interval G, and a plurality of reference electrode members 22.

Figure 13:
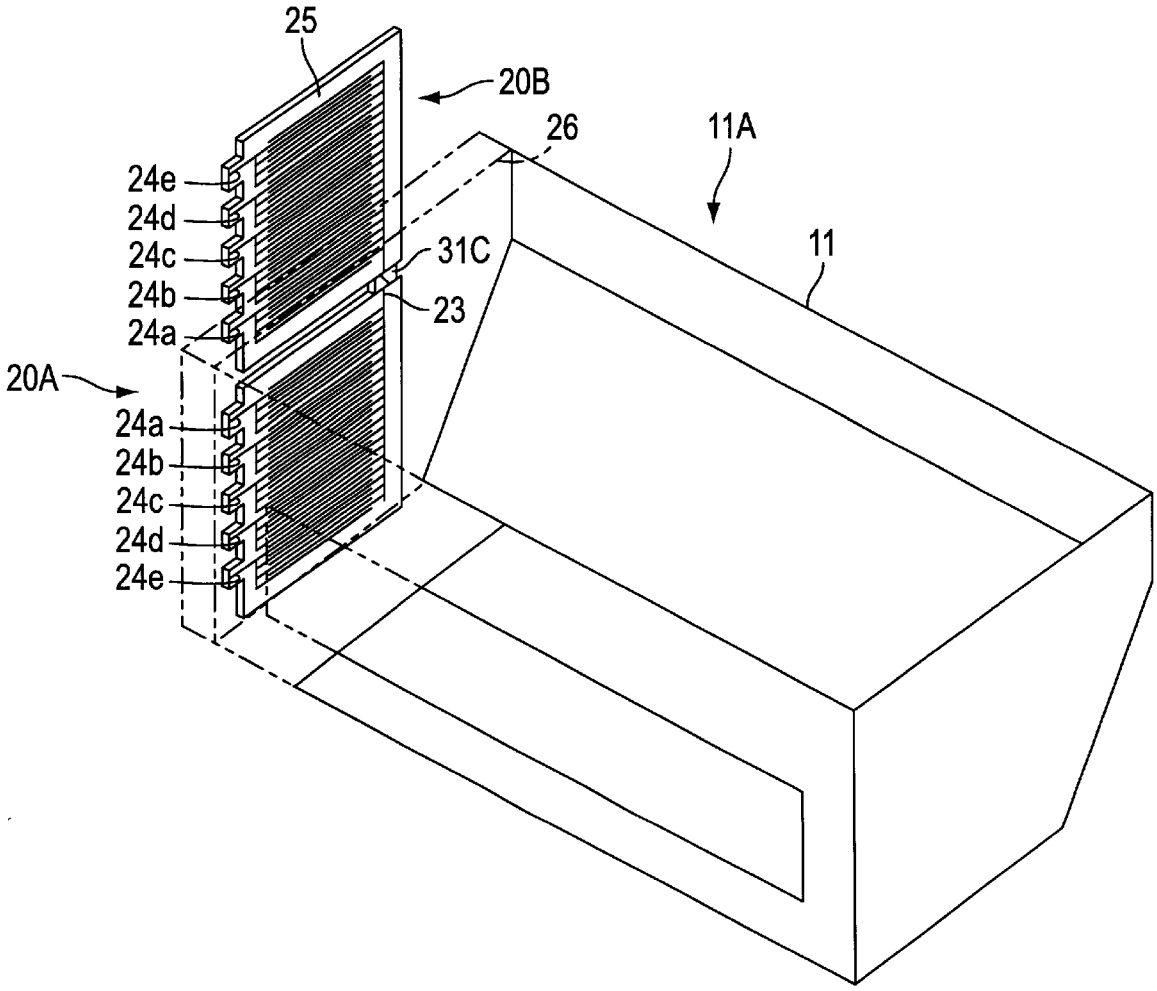
FIG. 13 is a perspective view of a developer container, for explaining an embodiment of a developer amount detecting device.
Figure 14:
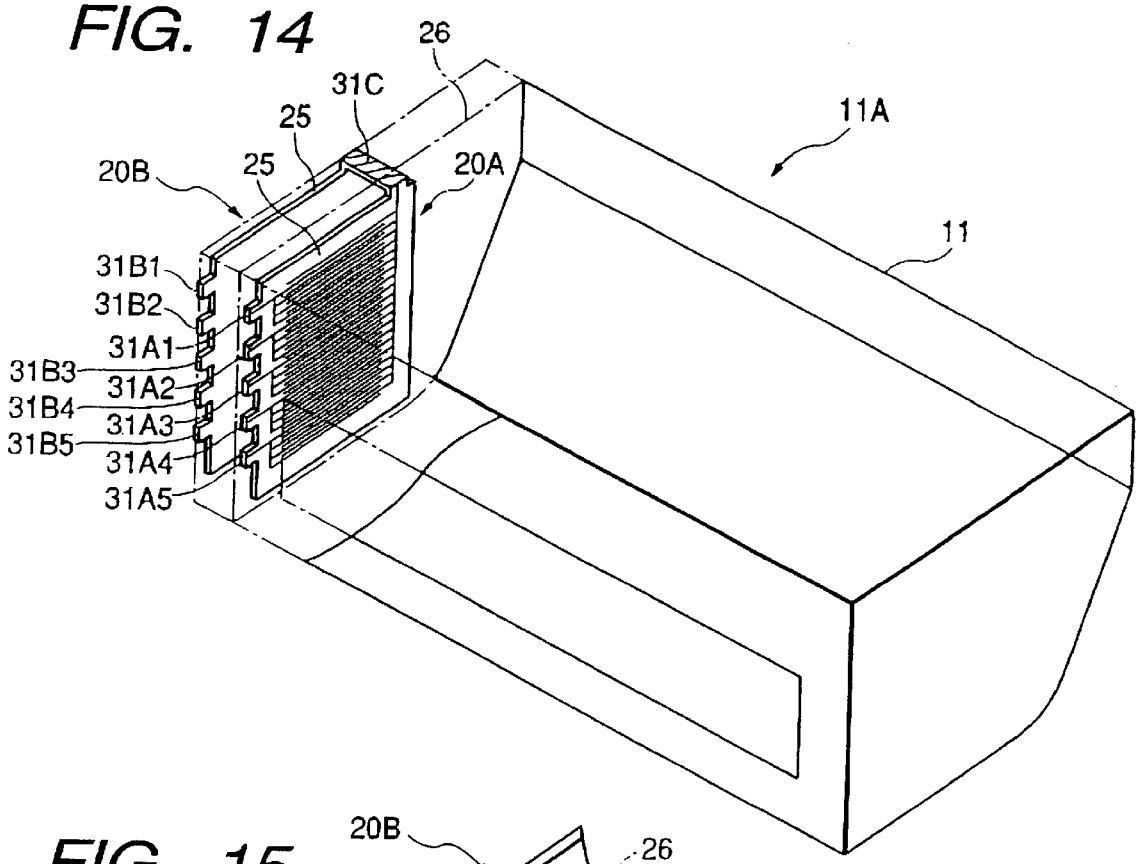
FIG. 14 is a perspective view of a developer container, similar to FIG. 13, for explaining an embodiment in which a comparative member is disposed within the developer container.

For example, as shown in FIG. 6, the detecting member 20A is located at a position (for example, an inner side surface or a bottom surface of the developer container 11A) where the detecting member 20A contacts the developer and in such a manner that a contact area between the detecting member 20A and the developer is changed as the amount of the developer is decreased. Further, as will be fully described later and for example as shown in FIGS. 13 and 14, the comparative member 20B is located at a position where it does not contact the developer, for example, at a position partitioned by a partition wall 26 and on the same side as the detecting member 20A within the developer container 11A.

Figure 7:
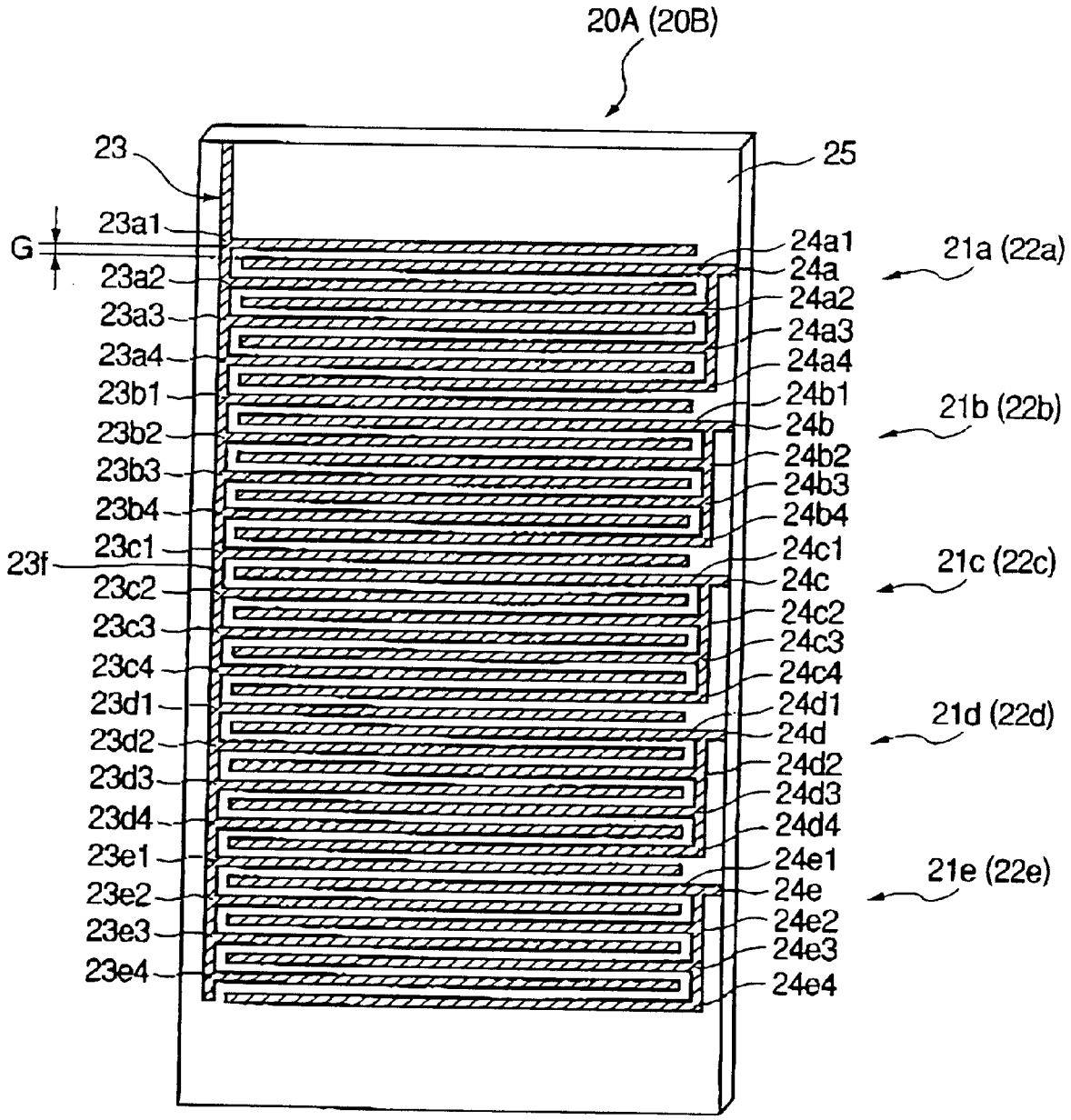
FIG. 7 is a front view showing an embodiment of a detecting member and a comparative member.

Explaining the detecting member 20A firstly, in the illustrated embodiment, as shown in FIG. 7, the detecting member 20A is constituted by first to fifth measuring electrode members 21*a* to 21*e* each having a pair of electrodes formed on the substrate 25 in parallel with a predetermined interval.

More specifically, input side electrode portions 23*a*1 to 23*a*4 and output side electrode portions 24*a*1 to 24*a*4 of a first output side electrode 24*a* constitute, in pairs, a pair of electrode patterns, i.e, a first measuring electrode member 21*a*, and, similarly, input side electrode portions 23*b*1 to 23*b*4 and output side electrode portions 24*b*1 to 24*b*4 of a second output side electrode 24*b*, input side electrode portions 23*c*1 to 23*c*4 and output side electrode portions 24*c*1 to 24*c*4 of a third output side electrode 24*c*, input side electrode portions 23*d*1 to 23*d*4 and output side electrode portions 24*d*1 to 24*d*4 of a fourth output side electrode 24*d*, and input side electrode portions 23*e*1 to 23*e*4 and output side electrode portions 24*e*1 to 24*e*4 of a fifth output side electrode 24*e* constitute respectively, in pairs, second to fifth measuring electrode members 21*b* to 21*e*, thereby providing five pairs of electrode patterns, i.e., five measuring electrode members 21*a* to 21*e* in total.

In the illustrated embodiment, each of the input side electrode portions and each of the output side electrode portions are juxtaposed in parallel with the predetermined interval G. Further, the input side electrode portions 23*a*1 to 23*e*4 are electrically interconnected via an input connection line 23*f*. On the other hand, the first to fifth output side electrodes 24*a* to 24*e* having the output side electrode portions 24*e*1 to 24*e*4, 24*b*1 to 24*b*4, 24*c*1 to 24*c*4, 24*d*1 to 24*d*4 and 24*e*1 to 24*e*4 are not electrically interconnected, thereby acting as independent electrodes.

Figure 8:
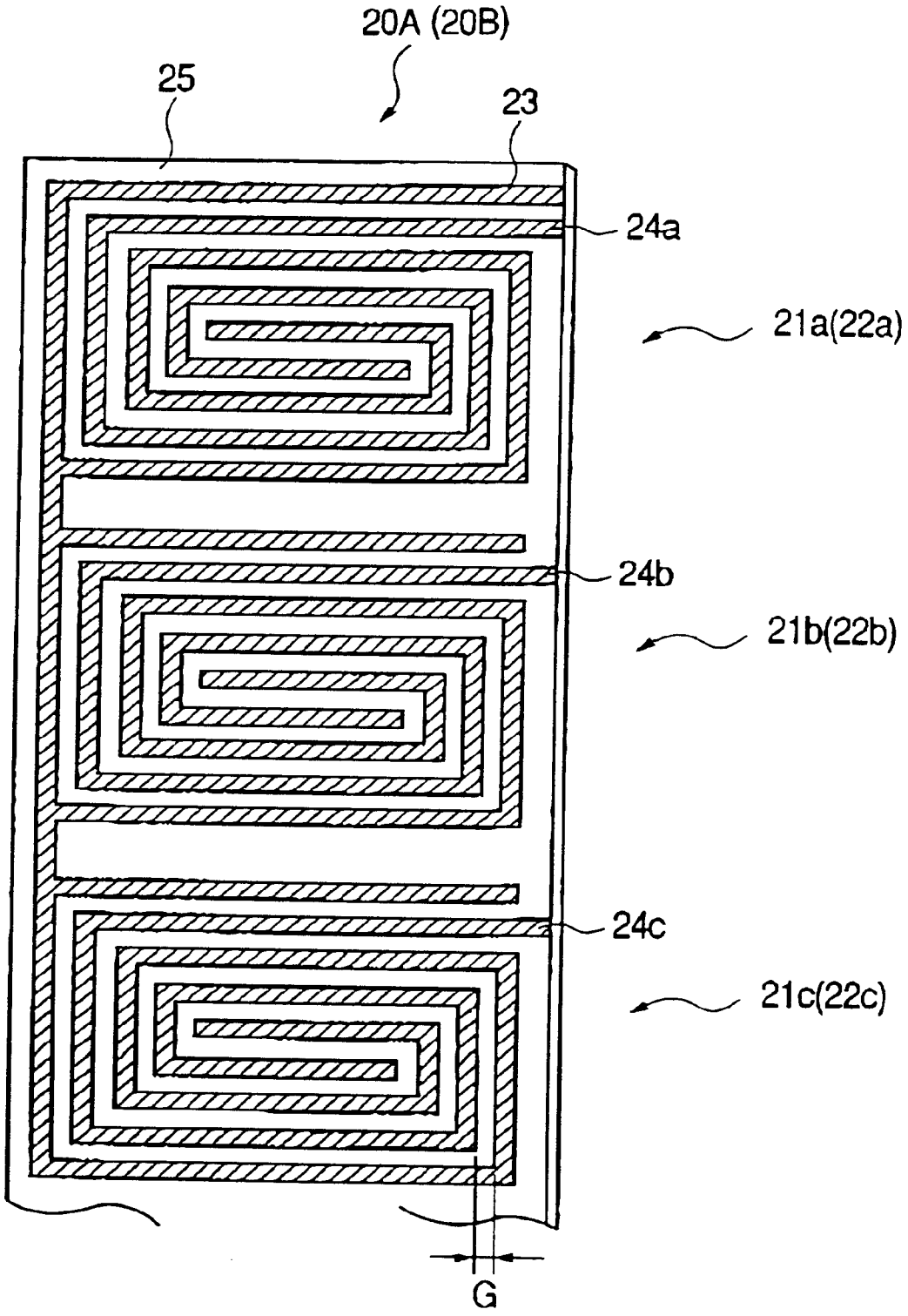
FIG. 8 is a front view showing another embodiment of a detecting member and a comparative member.

In this way, in the illustrated embodiment, the five pairs of electrode patterns of the first to fifth measuring electrode members 21*a* to 21*e* are interdigitated to each other to form a concave and a convex configuration. Of course, the electrode patterns of the measuring electrode member 20A are not limited to such electrode patterns, but, for example, as shown in FIG. 8, each electrode pattern may be formed as a spiral configuration having a portion in which the pair of electrode patterns 23, 24*a* are disposed in parallel with a predetermined interval.

Incidentally, as mentioned above, in the illustrated embodiment, in the input side electrode 23 of the measuring electrode members 21*a* to 21*e*, the electrode portions 23*a*1 to 23*e*4 are all electrically interconnected via the input connection line 23*f* on the substrate 25. With this arrangement, as will be fully described later, the number of contact parts can be reduced. However, the present invention is not limited to such an aspect, but, as a principle of the present invention, for example, as shown in FIG. 18, the detecting member 20A may be constituted to have a plurality of measuring electrode members 21.

The detecting member 20A can detect the amount of the developer in the developer container 11A stepwise by measuring the capacitances between the five pairs of electrodes of the first to fifth measuring electrode members 21*a* to 21*e*. Namely, since the developer has a dielectric constant greater than that of air, when the developer contacts the surface of the detecting member 20A, the capacitance between each pair of electrodes is increased. Accordingly, by counting the number of electrodes pairs (measuring electrode members 21*a* to 21*e*) to which the developer is contacted, the amount of the developer can be measured stepwise.

The method for measuring the remaining amount of the developer stepwise will be fully explained.

The developer is loaded in the developer container 11A shown in FIG. 6 in such a manner that, before the process cartridge B is used, i.e., when the developer container 11A is fully filled with the developer, the first measuring electrode member 21*a* is embedded in the developer. In this case, the capacitances between the input side electrode 23 and the first to fifth output side electrodes 24*a* to 24*e* are measured. For example, the capacitance between the input side electrode 23 and the first output side electrode 24*a* (capacitance of the first measuring electrode member 21*a*) is the capacitance generated between the input side electrode portions 23*a*1 to 23*a*4 and the output side electrode portions 24*a*1 to 24*a*4. Similarly, the capacitances between the input side electrode 23 and the second to fifth output side electrodes 24*b* to 24*e* (capacitances of the second to fifth measuring electrode members 21*b* to 21*e*) are capacitances generated between the input side electrode portions 23*b*1 to 23*b*4 and the output side electrode portions 24*b*1 to 24*b*4, between the input side electrode portions 23*c*1 to 23*c*4 and the output side electrode portions 24*c*1 to 24*c*4, between the input side electrode portions 23*d*1 to 23*d*4 and the output side electrode portions 24*d*1 to 24*d*4, and between the input side electrode portions 23*e*1 to 23*e*4 and the output side electrode portions 24*e*1 to 24*e*4, respectively.

The capacitances of the first to fifth measuring electrode members 21*a* to 21*e* in the unused condition of the process cartridge B are values when the dielectric constants becomes great due to the presence of the developer.

When the developer is consumed and the upper level of the developer reaches a lower end of the first measuring electrode member 21*a*, i.e., the vicinity of the electrode portion 24*a*4 of the first output side electrode 24*a*, the capacitance between the first output side electrode 24*a* and the input side electrode 23 is decreased since the dielectric constant of the developer is changed to a dielectric constant of the air.

When the developer is further consumed, the capacitance between the second output side electrode 24*b* of the second measuring electrode member 21*b* and the input side electrode 23 is decreased. Similarly, when the developer is further consumed, the capacitances of the third to fifth measuring electrode members 21*c* to 21*e* are decreased successively.

In the illustrated embodiment, since the capacitances when the dielectric constant of air acts between the first to fifth output side electrodes 24*a* to 24*e* and the input side electrode 23, i.e., the capacitances when the developer is not contacted with the first to fifth measuring electrode members 21*a* to 21*e* can be known by measuring the capacitances of the first to fifth reference electrode members 22*a* to 22*e* of the comparative member 20B (fully described later), if the capacitances of the measuring electrode members 21*a* to 21*e* coincide with the capacitances when the dielectric constant of air is applied, the fact that the developer is decreased to lower ends of the measuring electrode members 21*a* to 21*e* can be detected. In this way, the remaining amount of the developer can be detected from the first measuring electrode member 21*a* to the fifth measuring electrode member 21*e* in five steps. Incidentally, if the comparative member 20B is not provided, for example, the capacitances of the measuring electrode members 21*a* to 21*e* when the developer does not contact these members may be stored in memory means previously provided in the main body of the image forming apparatus and, by comparing the stored values with detected values, the decrease of the developer up to lower ends of the measuring electrode members 21*a* to 21*e* can be detected.

The electrode patterns 23*a*1 to 23*e*4 and 24*a*1 to 24*e*4 of the detecting member 20A can be obtained, for example, by forming patterns of conductive metal such as copper, by etching or printing, on a hard printed substrate 25 having a thickness of 0.4 to 1.6 mm and made of paper phenol or glass epoxy or a flexible printed substrate 25 having a thickness of about 0.1 mm and made of polyester or polyimide, and can be manufactured by a method which is the same as a normal method of forming a wiring pattern on the printed substrate. Accordingly, complicated electrode pattern configurations as shown in FIGS. 7 and 8 can easily be manufactured, with the result that the manufacturing cost is almost the same as the manufacturing cost for manufacturing a simple pattern.

Further, by utilizing the complicated pattern configurations as shown in FIGS. 7 and 8, an opposed length between the input side electrode and the output side electrode can be lengthened, and, the interval G between the electrode portions can be reduced to several tens of $\mu$m by using the pattern forming method such as etching, thereby obtaining great capacitance. Further, a change amount of the capacitance can be made greater, thereby enhancing detection accuracy. More specifically, the electrode portions 23*a*1 to 23*e*4 and 24*a*1 to 24*e*4 have a width of 0.1 to 0.5 mm and a thickness of 17.5 to 70 $\mu$m, and the interval G is made to 0.1 to 0.5 mm. Further, the metal pattern forming surface can be coated by a thin resin film having a thickness of about 12.5 to 125 $\mu$m, for example.

As mentioned above, in the developer amount detecting device according to the illustrated embodiment, the change in contact area of the developer with respect to the detecting member 20A located on the inner side surface of the developer container 11A in the direction along which the developer is decreased, i e., the change in capacitances between the first to fifth output side electrodes 24*a* to 24*e* of the first to fifth measuring electrode members 21*a* to 21*e* of the detecting member 20A and the input side electrode 23 is measured, thereby detecting the entire developer amount in the developer container 11A stepwise. Since the dielectric constant of the developer is greater than that of air, the portions (contacted with the developer) between the output side electrodes 24*a* to 24*e* of the measuring electrode members 21*a* to 21*e* and the input side electrode 23 have outputted capacitances greater than those in the not-contacted portions (portions on which the developer is not existed) Accordingly, by measuring the change in capacitances of the measuring electrode members 21*a* to 21*e*, the amount of the developer in the developer container 11A can be guessed stepwise.

Next, the reference electrode member 20B will be explained. According to the illustrated embodiment, as shown in FIG. 6, the developer amount detecting device further has the comparative member 20B having the same construction as the detecting member 20A. According to the illustrated embodiment, as shown in FIG. 7, the comparative member 20B is constructed the same as the detecting member 20A and thus has first to fifth reference electrode members 22*a* to 22*e* having the same construction as the first to fifth measuring electrode members 21*a* to 21*e* of the detecting member 20A. Further, similar to the detecting member 20A, input side electrodes for the reference electrode members 22*a* to 22*e* are electrically connected to the input side electrode 23. In this way, since the comparative member 20B has the same construction as the detecting member 20A, a detailed explanation thereof will be omitted.

The comparative member 20B has its capacitance changed in accordance with environmental conditions, such as a temperature and humidity, and acts as a reference with respect to the detecting member 20A.

Namely, in the developer amount detecting device according to the illustrated embodiment, the output of the detecting member 20A is compared with the output of the comparative member 20B changed in accordance with a change in environment. For example, in a case where a predetermined capacitance of the comparative member 20B is set to the same value as that of the detecting member 20A when there is no developer, by seeking the difference in output between the comparative member 20B and the detecting member 20A, since the output based on only the change in capacitance due to the pressure of the developer can be obtained, the accuracy of developer remaining amount detection can be enhanced.

Further explaining the developer amount detecting principle according to the illustrated embodiment, since the detecting member 20A guesses the developer amount in the developer container 11A by measuring the capacitance between the developer and the pattern surface, the guessed value is changed in accordance with the change in environment (temperature, humidity and the like).

For example, since the amount of moisture in air is increased if the humidity is increased, the dielectric constant of air contacting the detecting member 20A is also increased. Thus, even in the same developer amount, if the environment is changed, the output from the detecting member 20A will be changed. Further, if the substrate 25 on which the electrode patterns are formed is formed from moisture absorbing material, since the dielectric constant is changed by moisture absorption, the environmental variation is realized.

Thus, by installing the comparative member 20B subjected to the same environmental change as the detecting member 20A (i.e., for example, the comparative member 20B having the same construction as the detecting member 20A and not contacting the developer) in the same environmental condition as the detecting member 20A and by comparing both outputs to determine the difference and by cancelling the environmental variation, the developer remaining amount can be measured without the influence of the environmental variation.

Figure 9:
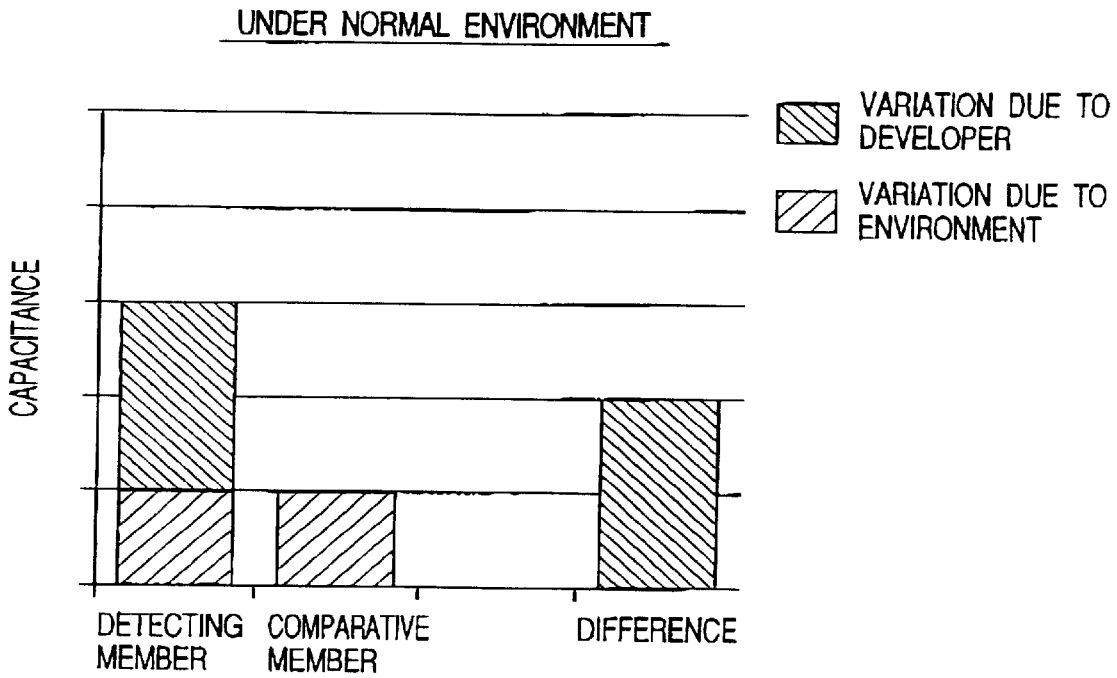
FIG. 9 is a graph for explaining a developer amount detecting principle.
Figure 10:
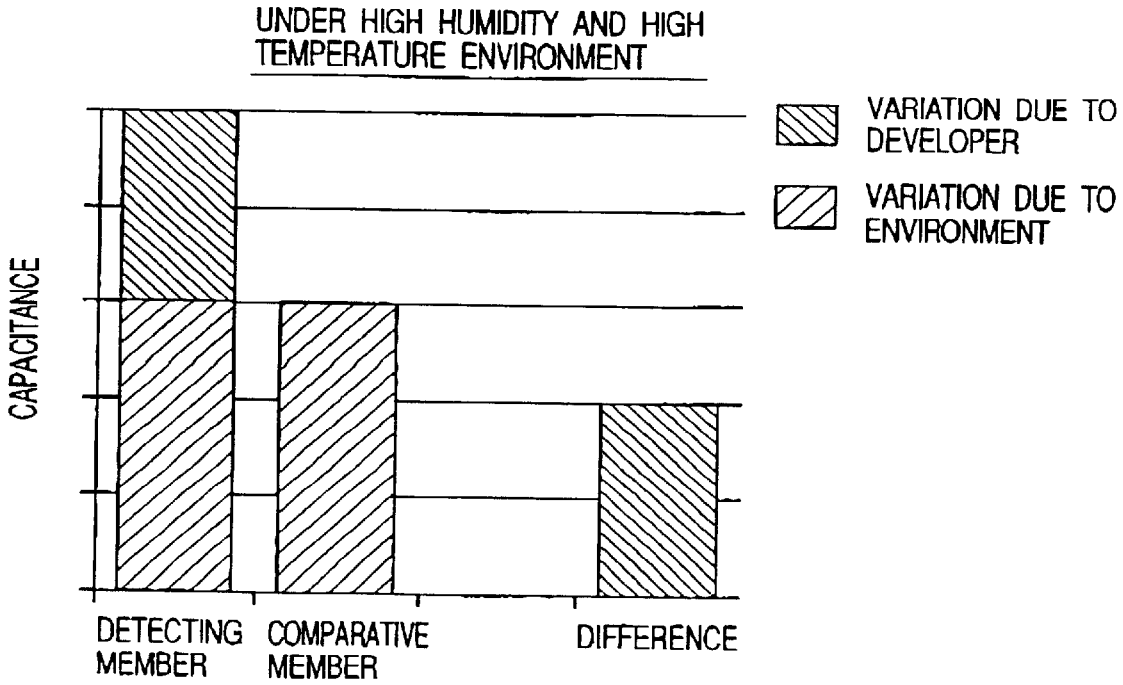
FIG. 10 is a graph for explaining a developer amount detecting principle.

As shown by a left-most bar graph in FIG. 9, the capacitance measured from the detecting member 20A for detecting the developer amount is outputted as a variation due to the developer plus a variation due to the environment, If the environment is changed to a high temperature and a high humidity, the capacitance is increased even in the same developer amount as shown by a left-most bar graph in FIG. 10 because the variation due to the environment is increased even though the variation due to developer is not changed.

To avoid this, as shown by the center bar graphs in FIGS. 9 and 10, by providing the comparative member 20B having the same environmental variation property as the detecting member 20A and by determining the difference (right-most bar graphs), only the capacitance due to developer can be measured.

Figure 11:
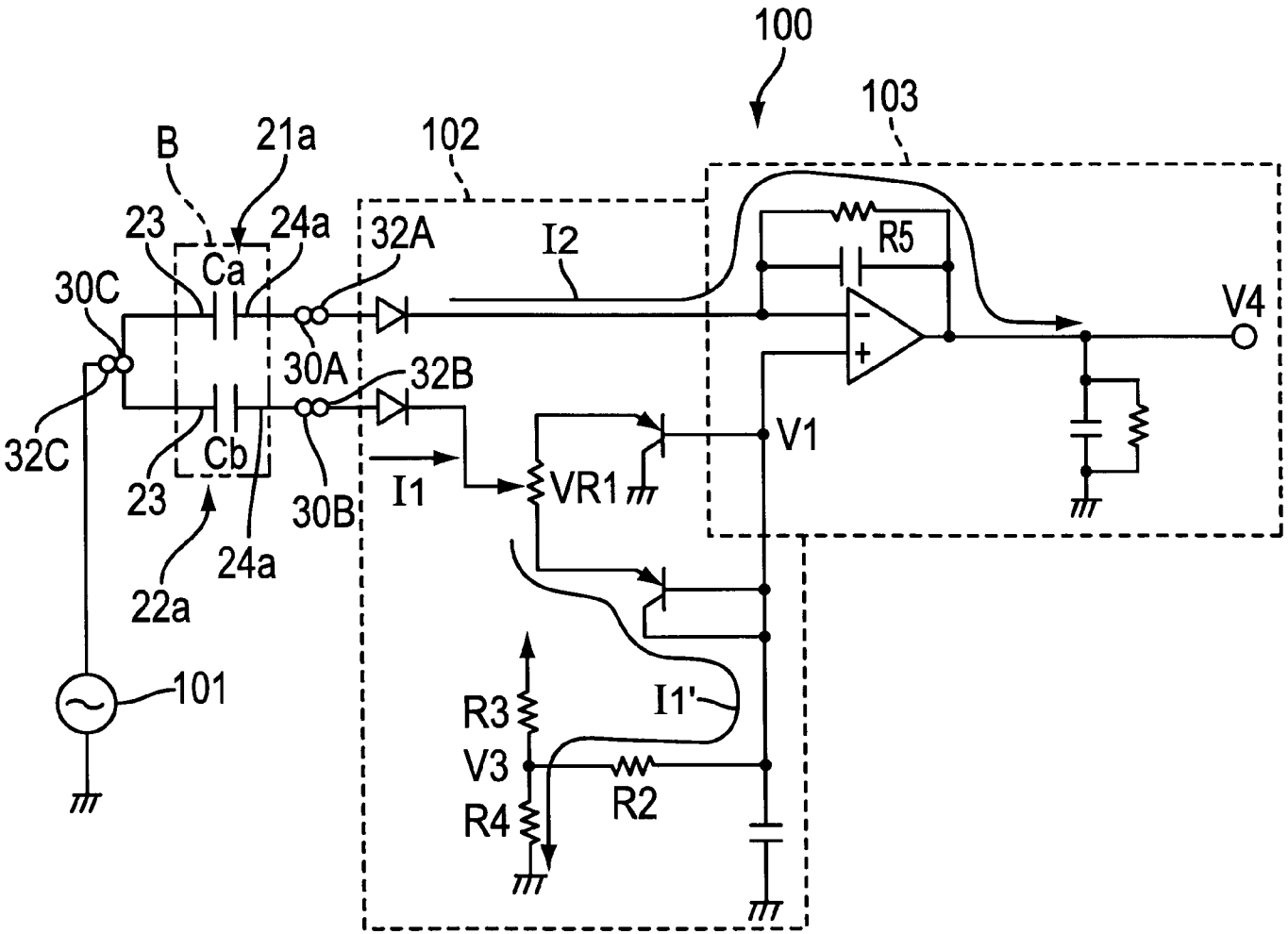
FIG. 11 is a view showing an embodiment of a developer amount detecting circuit for the developer amount detecting device.

The developer amount detecting device embodying such principle according to the illustrated embodiment will be further explained with reference to FIG. 11. FIG. 11 shows an example of a developer amount detecting circuit in which the connection condition between the first measuring electrode member 21*a* and the first reference electrode member 22*a* is also illustrated as an example of the detecting member 20A and the comparative member 20B in the image forming apparatus.

The first measuring electrode member 21*a* of the detecting member 20A having capacitance Ca varied with the developer amount and the first reference electrode member 22*a* of the comparative member 20B having capacitance Cb varied with the environmental condition are, as impedance elements, connected to a developing bias circuit (developing bias applying means) 101 as voltage applying means through a contact 30C (and main body side contact 32C) at their input side electrodes 23, and the other first output side electrodes 24*a*, 24*a* are connected to a control circuit 102 of a developer amount detecting circuit 100 through contacts 30A (and main body side contact 32A) and 30B (and main body side contact 32B). The first reference electrode member 22*a* of the comparative member 20B sets a reference voltage V1 for detecting the developer remaining amount by using AC (alternate current) electric current $I_1$ applied through the developing bias circuit 101.

As shown in FIG. 11, the control circuit 102 determines the reference voltage V1 by adding AC electric current $I_1'$ (obtained by shunting AC electric current $I_1$ applied to the first reference electrode member 22*a* of the comparative member 20B, i.e., impedance element by volume VR1) and voltage drop generated in resistance R2 to set voltage V3 set in resistances R3, R4.

Accordingly, AC (alternate current) electric current $I_2$ applied to the first measuring electrode member 21*a* of the detecting member 20A is inputted to an amplifier 103 and is outputted as a detection value V4 ($V1-I_2 \times R5$) for the developer remaining amount. The output value is utilized as the detection value for the developer remaining amount.

The measurements using the other measuring electrode members 21*b* to 21*a* of the detecting member 20A and the other reference electrode members 22*b* to 22*e* of the comparative member 20B having the capacitance Cb varied with the environmental condition are similarly effected.

As mentioned above, according to the developer amount detecting device according to the illustrated embodiment, since the comparative member 20B having the first to fifth reference electrode members 22*a* to 22*e* having their capacitance varied with the environment similar to the first to fifth measuring electrode members 21*a* to 21*e* of the detecting member 20A is provided, the environmental variation of the detection member 20A can be cancelled, thereby detecting the developer remaining amount with high accuracy.

Figure 12:
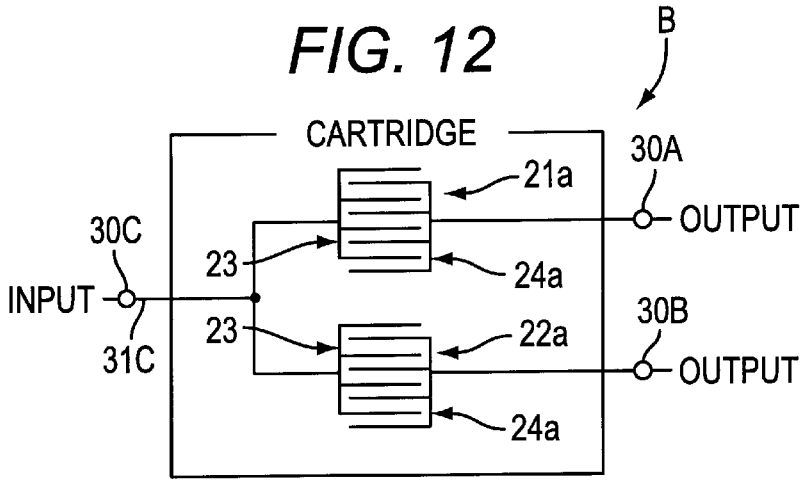
FIG. 12 is a view for explaining an arrangement of a measuring electrode member and a reference electrode member.

According to the illustrated embodiment, as shown in FIGS. 12 to 14, the detecting member 20A and the comparative member 20B having the same construction as the detecting member 20A are installed within the developer container 11A. With this arrangement, since the developer container 11A has the detecting member 20A and the comparative member 20B, the variation due to environment can be cancelled, and, since the detecting member 20A and the comparative member 20B, the variation due to environment can be cancelled, and, since the detecting member 20A and the comparative member 20B can be installed under substantially the same environment, the detecting accuracy can be enhanced.

Further, according to the illustrated embodiment, as shown in FIGS. 11 and 12, the process cartridge B has three contacts, i.e., a common input contact 30C commonly used by the detecting member 20A and the comparative member 20B regarding the respective measuring electrode member and reference electrode member of the detecting member 20A and the comparative member 20B, and a measuring electrode output contact 30A and a reference electrode output contact 30B for detection and comparison output. As mentioned above, according to the illustrated embodiment, since the input side electrodes 23 of the measuring electrode members 21*a* to 21*e* and reference electrode members 22*a* to 22*e* of the detecting member 20A and the comparative member 20B are electrically interconnected by the input connection line 23*f*, a single input contact 30C may be provided for the entire detecting member 20A and comparative member 20B.

That is to say, in the illustrated embodiment, since the voltage is inputted and outputted between the main body 14 of the apparatus and the detecting member 20A and the comparative member 20B, the process cartridge B is provided with measuring electrode output contacts 30A1 to 30A5, reference electrode output contacts 30B1 to 3OB5 and common input contact 30C, and the main body 14 of the apparatus is provided with contacts 32A1 to 32A5, 32B1 to 32B5 and 32C to be electrically connected to the above-mentioned contacts, respectively.

With this arrangement, the number of contact parts can be reduced, thereby reducing the cost. Further, by making the input signal common, the input pulses can be made identical, thereby enhancing the accuracy.

Further explaining, according to the illustrated embodiment, as can be understood from FIGS. 13 and 14, regarding the detecting member 20A and the comparative member 20B, the electrodes, i.e., input side electrode 23 and output side electrodes 24*a* to 24*e* are formed on one surface of a single bendable substrate 25 such as a flexible printed substrate, and the substrate is installed in the developer container 11A in a folded condition. Further, as mentioned above, in the illustrated embodiment, the detecting member 20A and the comparative member 20B have the same electrode patterns. Namely, the detecting member 20A and the comparative member 20B have, respectively, the measuring electrode members 21*a* to 21*e* and the reference electrode members 22*a* to 22*e* having substantially the same capacitance and having the pattern configuration having substantially the same pattern width, length, interval and opposed area. The comparative member 20B manufactured in this way is folded at a central portion of the substrate and is situated within the developer container 11A at a location partitioned from the detecting member 20A by the partition wall 26 and not contacted with the developer.

As mentioned above, the detecting member 20A and the comparative member 20B are manufactured in a similar manner to the normal printed substrate manufacturing process, and, thus, dispersion in capacitance of the substrate is caused due to the moisture absorbing ratio of material, the dispersion in dielectric constant and/or dispersion in electrode pattern width and the height caused by a difference in etching conditions. In the present invention, since the single substrate acts both as the detecting member and the comparative member by forming the detecting member 20A and the comparative member 20B on the same surface of the substrate 25, only one substrate is used, thereby reducing the cost. Further, since the electrode patterns are formed on the same material, dispersion due to a difference in material can be suppressed, and, since the patterns are formed on the same surface, dispersion caused in the pattern forming, such as etching, can be also suppressed. Furthermore, with the above-mentioned arrangement, the detecting pattern can be arranged up to an upper portion of the developer container 11A, with the result that the developer amount can be measured from a full-filled state of the developer container.

Figure 15:
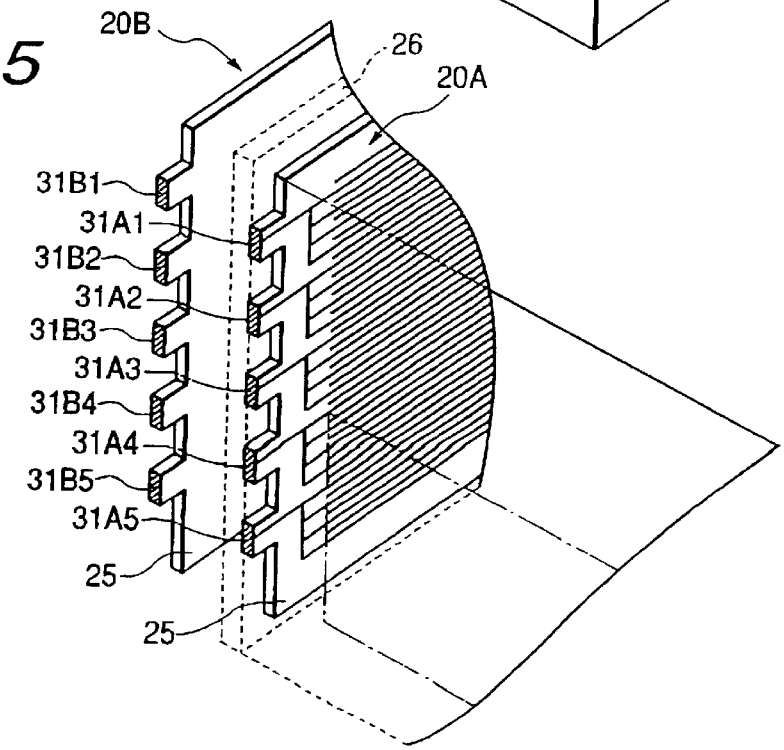
FIG. 15 is a view for explaining a connection arrangement between terminals of the measuring electrode member and the reference electrode member of the detecting member and the comparative member.

As can be understood also by referring to FIG. 15, from the substrates 25 on which the detecting member 20A and the comparative member 20B are formed, measuring electrode output terminals 31A1 to 31A5 electrically connected to the first to fifth output side electrodes 24*a* to 24*e* of the detecting member 20A, reference electrode output terminals 31B1 to 31B5 electrically connected to the first to fifth output side electrodes 24*a* to 24*e* of the comparative member 20B and a common input terminal 31C (FIG. 14) electrically connected to the input side electrodes 23 of the detecting member 20A and the comparative member 20B are protruded.

The measuring electrode output terminals 31A1 to 31A5, reference electrode output terminals 31B1 to 31B5 and common input terminal 31C are used as the measuring electrode output contacts 30A1 to 30A5, reference electrode output contacts 30B1 to 30B5 and common input contact 30C, so that, when the process cartridge B is mounted to the main body 14 of the apparatus, the contacts 30Al to 30A5, 30B1 to 30B5 and 30C can be electrically connected to the measuring electrode output contacts 32A1 to 32A5, reference electrode output contacts 32B1 to 32B5 and common input contact 32C of the main body 14 of the apparatus, thereby electrically connecting the detecting member 20A and the comparative member 20B to the developer amount measuring circuit 100 and the developing bias circuit 101 as the voltage applying means as shown in FIG. 11.

Figure 4:
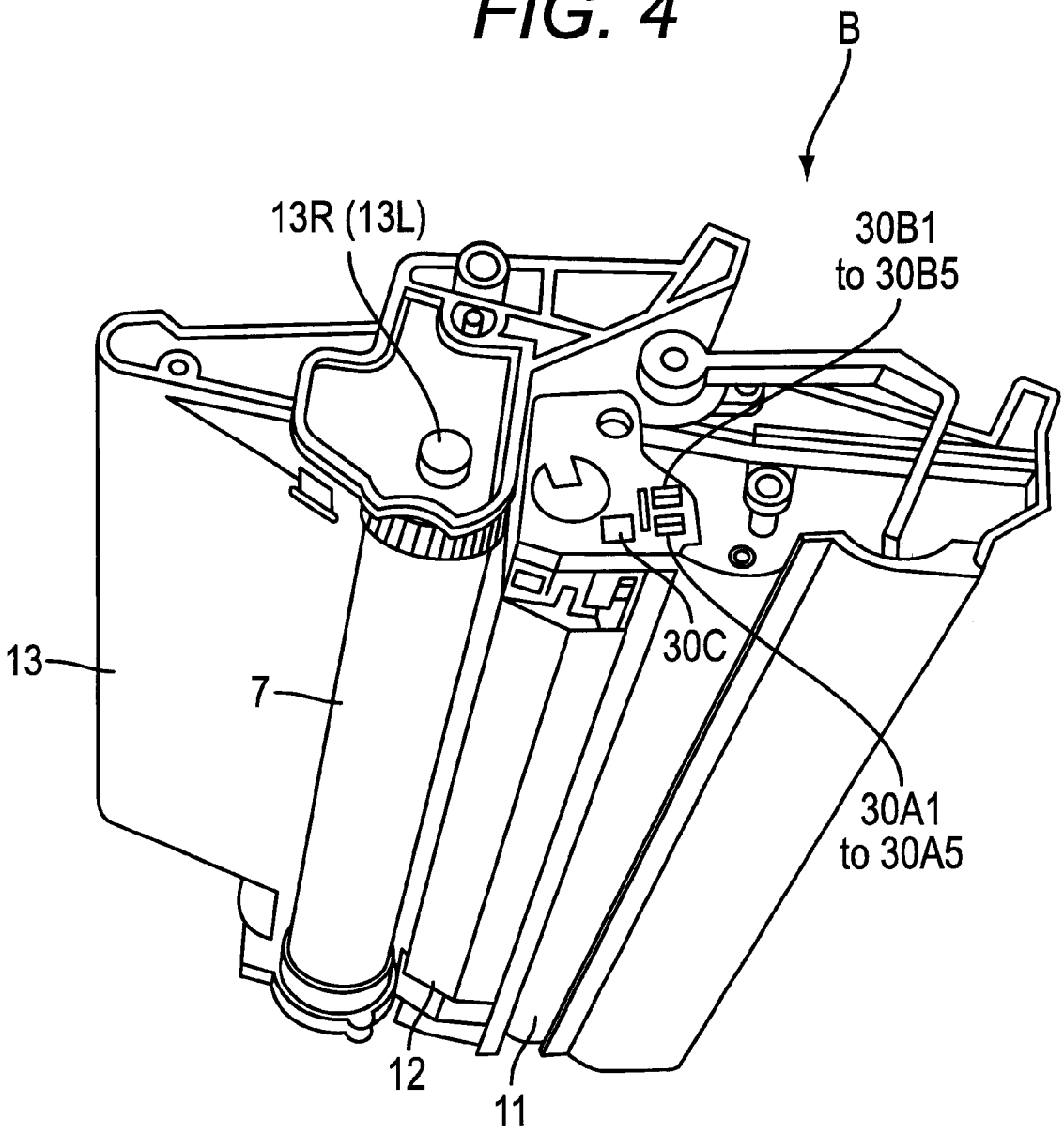
FIG. 4 is a perspective view of the process cartridge looking from below.
Figure 5:
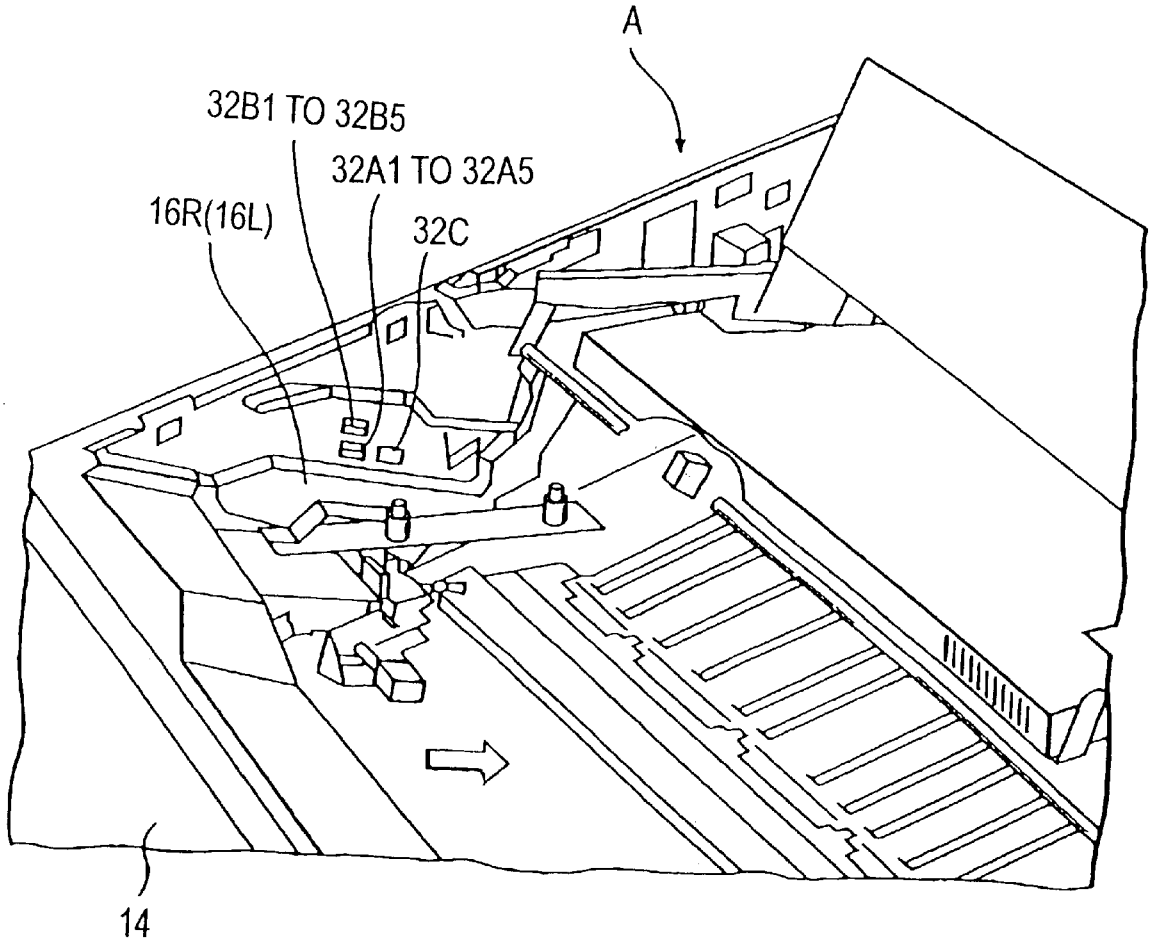
FIG. 5 is a perspective view showing a mounting portion of a main body of the image forming apparatus for mounting the process cartridge.

Further, for example, by the limitation of arrangement of the Contacts within the process cartridge B and the main body 14 of the apparatus, if the measuring electrode output terminals 31A1 to 31A5, reference electrode output terminals 31B1 to 31B5 and common input terminal 31C cannot be used as the contacts to the main body 14 of the apparatus, for example, as shown in FIG. 4, the measuring electrode output contacts 30A1 to 30A5, reference electrode output contacts 30B1 to 30B5 and common input contact 30C exposed on the outer side surfaces of the process cartridge B may be electrically connected to the above-mentioned terminals to be electrically connected to the contacts 32A1 to 32A5, 32B1 to 32B5 and 32C of the main body 14 of the apparatus.

In the illustrated embodiment, while an example that the electrode patterns of the first to fifth measuring electrode members 21*a* to 21*e* and the first and fifth reference electrode members 22*a* to 22*e* of the detecting member 20A and the comparative member 20B, i.e., the input side electrode 23 and the first to fifth output side electrodes 24*a* to 24*e* have substantially the same capacitance and have pattern configurations having substantially the same pattern width, length, interval and opposed area as was explained, the area of the electrode pattern of the reference electrode members 22*a* to 22*e* of the comparative member 20B may be different from the area of the electrode pattern of the measuring electrode members 21*a* to 21*e* of the detecting member 20A. In this case, the outputs of the reference electrode members 22*a* to 22*e* of the comparative member 20B are converted into outputs multiplied by a predetermined coefficient, and the converted outputs are compared with the outputs of the measuring electrode members 21*a* to 21*e* of the detecting member 20A. With this arrangement, since the comparative member 20B can be made smaller, a space for installing the measuring parts can be saved. Further, although the detecting member 20A and the comparative member 20B can be provided on the same wall surface in the developer container 11A at the same side and the comparative member 20B can be partitioned not to contact with the developer, in this case, by reducing the electrode pattern area of the comparative member 20B with respect to that of the detecting member 20A can be increased within the limited area, thereby enhancing the change amount of capacitance and the detection accuracy.

Incidentally, in the specification, while the fact that the values of capacitances generated when the voltage is applied to the electrode members becomes the same was described, not only the case where the values become identical, but also a technique in which the members are manufactured so that the values become identical is also included. Accordingly, for example, the error due to dispersion in manufacture of the electrode members is included in the fact that the values are the same.

Similarly, the description in which the numerical values and configuration are the same, such as "the interval between the electrode members is constant", "the opposed lengths of the electrodes are the same", "intervals between the opposed portions are the same", "the configuration of the measuring electrode member and the reference electrode member are the same", and the like includes a product in which the members are manufactured so that the values or configurations become the same. Accordingly, for example, an error in numerical value due to dispersion in manufacture and a difference in configuration are included in the fact that the values or the configuration are the same.

Further, as mentioned above, according to the illustrated embodiment, although the developer container 11A is provided with the detecting member 20A and the comparative member 20B to detect the developer remaining amount, it is more preferable that the developing chamber 9A of the developing means 9 is provided with an antenna rod, i.e., an electrode rod 9*h* (FIG. 3) extending by a predetermined length in a longitudinal direction of the developing roller 9*a* with a predetermined gap with respect to the developing roller 9*a*. With this arrangement, by detecting a change in capacitance between the developing roller 9*a* and the electrode rod 9*h*, the end of the developer can be detected.

Now, the present invention will be explained with reference to FIG. 16.

In an embodiment shown in FIG. 16, in order to enhance the detecting accuracy as the developer is consumed, intervals between the electrode portions of the electrode patterns of the plurality of measuring electrode members and reference electrode members of the detecting member 20A and the comparative member 20B are gradually decreased as the patterns advance downwardly.

That is to say, regarding the intervals between the electrode portions of the input side electrode 23 and the first to fifth output side electrodes 24*a* to 24*e* in the detecting member 20A and the comparative member 20B, when it is assumed that the interval between the input side electrode portions 23*a*1 to 23*a*4 and the output side electrode portions 24*a*1 to 24*a*4 of the first output side electrode 24*a* is G1, the interval between the input side electrode portions 23*b*1 to 23*b*4 and the output side electrode portions 24*b*1 to 24*b*4 of the second output side electrode 24*b* is G2, the interval between the input side electrode portions 23*c*1 to 23*c*4 and the output side electrode portions 23*c*1 to 23*c*4 of the third output side electrode 24c is G3, the interval between the input side electrode portions 23*d*1 to 23*d*4 and the output side electrode portions 24*d*1 to 24*d*4 of the fourth output side electrode 24d is G4, and the interval between the input side electrode portions 23*e*1 to 23*e*4 and the output side electrode portions 24*e*1 to 24*e*4 of the fifth output side electrode 24*e* is G5, the magnitude of intervals is changed as the developer is consumed to establish a relationship G1>G2>G3>G4>G5. Namely, the lower measuring electrode member in the direction along which the developer is decreased, the narrower the interval between the electrode portions. Incidentally, in this case, the comparative member 20B can have the same electrode pattern as that of the detecting member 20A.

With the above-mentioned arrangement, as the service life of the process cartridge B approaches its expiration, the remaining amount of the developer can be grasped more correctly, with the result that the user can recognize the exchanging time of the process cartridge more correctly.

Figure 17:
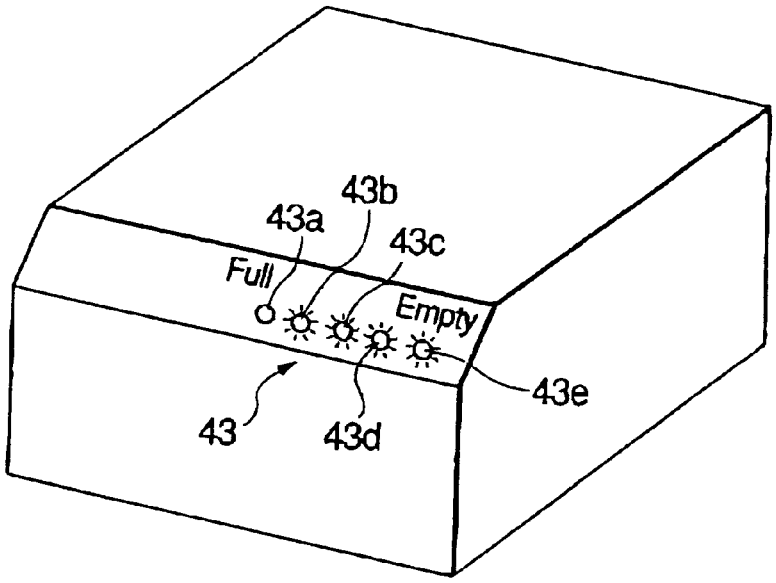
FIG. 17 is a view showing an example of indication of a developer.

Next, an indication of the developer amount will be explained. Although indication of information regarding the detection of the developer amount obtained by the developer amount detecting device is not limited to the following indication manner, for example, as shown ion FIG. 17, an indicating portion such as an LED 43 may be directly provided on the main body of the electrophotographic image forming apparatus and the information regarding the developer amount can be communicated to the user by flickering the LED 43. In this case, when the change in capacitances of the first to fifth measuring electrode members 21*a* to 21*e* is detected as mentioned above and the LED 43 is turned OFF successively, for example, in the order of 43*a*→43*b*→43*c*→43*d*→43*e*, the user can recognize the remaining amount of the developer stepwise.

Further, information regarding the detection of the developer amount can be displayed on an indicating portion, such as a liquid crystal display, provided on the main body of the image forming apparatus and a screen of a terminal, such as a user's personal computer, connected in communication with the main body 14 of the image forming apparatus. Alternatively, the information can be recorded on the recording medium 2 and outputted.

Incidentally, in the above explanation, while an example that the detecting member 20A and the comparative member 20B have five pairs of electrode patterns, i.e., first to fifth measuring electrode members 21*a* to 21*e* and first to fifth reference electrode members 22*a* to 22*e* to detect the developer in five steps and the remaining amount of the developer is indicated in five steps by the LEDs 43*a* to 43*e* was explained, the number of the measuring electrode members and reference electrode members can be set voluntarily, and, accordingly, in dependence upon the number of electrode pairs, the detection step number of the developer and the indication step number can be set voluntarily.

Incidentally, the present invention is not limited to the fact that, when the amount of the developer initially contained in the container is assumed to 100%, the developer amount is detected stepwise through the entire range from 100% to 0%. For example, the developer amount may be detected stepwise in the range from 50% to 0%. Here, the expression "developer remaining amount is 0%" includes the fact that, even if the developer is remaining in the container, the remaining amount of the developer is decreased up to the extent that a predetermined image quality (development quality) cannot be obtained.

Further, in the above explanation, while an example that the image forming apparatus is an electrophotographic image forming apparatus of the process cartridge type was explained, it can be understood, from the explanation of the above-mentioned embodiments, that the principle of the present invention can be applied to an image forming apparatus to which a developing device or a developer container is detachably mountable, and an image forming apparatus to which a developing device or a developer container is secured and developer can be supplied to the apparatus.

As mentioned above, in the process cartridge according to the present invention and the electrophotographic image forming apparatus to which the process cartridge is detachably mountable, the remaining amount of the developer in the developer container, as the developer container portion, can stepwise detected more correctly as the developer is consumed.

While the invention has been described with reference to the structures described herein, it is not confined to the details set forth and this application is intended to cover such modifications or changes as may come within the purposes of the improvements or the scope of the following claims.

What is claimed is:

1. A process cartridge detachably mountable to a main body of an electrophotographic image forming apparatus, said process cartridge comprising:

(a) an electrophotographic photosensitive member;

(b) process means acting on said electrophotographic photosensitive member;

(c) a developer container for containing developer;

(d) a plurality of measuring electrode members disposed at a location to be contactable with the developer and including input side and output side electrodes having at least one pair of portions juxtaposed with a predetermined interval therebetween, the interval between said juxtaposed portions of said input side and output side electrodes of said plurality of measuring electrode members being different for every measuring electrode member;

(e) a plurality of measuring electrode output contacts electrically connected to said output side electrodes of said plurality of measuring electrode members; and (f) a common input contact electrically connected to said input side electrodes of said plurality of measuring electrode members.

2. A process cartridge according to claim 1, further comprising a plurality of reference electrode members disposed at a location out of contact with the developer and including input side and output side electrodes having at least one pair of portions juxtaposed with a predetermined interval therebetween, a plurality of reference electrode output contacts electrically connected to said output side electrodes of said plurality of reference electrode members, and a common input contact electrically connected to said input side electrodes of said plurality of reference electrode members.

3. A process cartridge according to claim 1, wherein the interval between said juxtaposed portions of said input side and output side electrodes of said plurality of measuring electrode members becomes narrower in a measuring electrode member disposed lower in a direction along which the developer is decreased.

4. A process cartridge according to any one of claims 1 to 3, wherein said plurality of measuring electrode members are formed on a single substrate.

5. A process cartridge according to claim 2, wherein said plurality of reference electrode members have the same values of capacitances, generated when voltage is applied to said plurality of reference electrode members and said plurality of measuring electrode members under a condition that said plurality of measuring electrode members do not contact the developer, as those of said plurality of measuring electrode members, respectively.

6. A process cartridge according to claim 5, wherein a width between said juxtaposed portions of said input side and output side electrodes with the predetermined interval, a length of opposed portions, the interval between the opposed portions and an opposed area of said plurality of reference electrode members are the same as those Of said plurality of measuring electrode members.

7. A process cartridge according to claim 2, wherein said plurality of reference electrode members have values of capacitances, generated when voltage is applied to said plurality of reference electrode members and said plurality of measuring electrode members under a condition that said plurality of measuring electrode members do not contact the developer, different from those of said plurality of measuring electrode members, respectively and the values of the capacitances of said plurality of reference electrode members are made the same as those of said plurality of measuring electrode members by multiplying the values by predetermined coefficients.

8. A process cartridge according to claim 7, wherein said plurality of reference electrode members have capacitances values, generated when voltage is applied to said plurality of reference electrode members and said plurality of measuring electrode members under a condition that said plurality of measuring electrode members do not contact the developer, smaller than those of said plurality of measuring electrode members, respectively.

9. A process cartridge according to claim 7 or 8, wherein said plurality of reference electrode members have electrode patterns whose areas are smaller than those of said plurality of measuring electrode members, respectively.

10. A process cartridge according to claim 8, wherein said plurality of reference electrode members are formed on a single substrate.

11. A process cartridge according to claim 2, wherein said plurality of measuring electrode members and said plurality of reference electrode members are formed on a single substrate.

12. A process cartridge according to claim 1, wherein the process cartridge integrally incorporates at least one of charging means, developing means and cleaning means as said process means, and said electrophotographic photosensitive member as a cartridge unit which can detachably be mounted to said main body of said electrophotographic image forming apparatus.

13. An electrophotographic image forming apparatus to which a process cartridge is detachably mountable for forming an image on a recording medium, said electrophotographic image forming apparatus comprising:

(a) mounting means for detachably mounting a process cartridge, said process cartridge including an electrophotographic photosensitive member, process means acting on said electrophotographic photosensitive member, a developer container for containing developer, a plurality of measuring electrode members disposed at a location to be contactable with the developer and including input side and output side electrodes having at least one pair of portions juxtaposed with a predetermined interval therebetween, the interval between said juxtaposed portions of said input side and output side electrodes of said plurality of measuring electrode members being different for every measuring electrode member, a plurality of measuring electrode output contacts electrically connected to said output side electrodes of said plurality of measuring electrode members, and a common input contact electrically connected to said input side electrodes of said plurality of measuring electrode members, and a common input contact electrically connected to said input side electrodes of said plurality of measuring electrode members; and (b) electrostatic latent image forming means for forming an electrostatic latent image on said electrophotographic photosensitive member.

* * * * *

UNITED STATES PATENT AND TRADEMARK OFFICE

CERTIFICATE OF CORRECTION

PATENT NO. : 6,415,111 B1
DATED : July 2, 2002
INVENTOR(S) : Akira Higeta

It is certified that error appears in the above-identified patent and that said Letters Patent is hereby corrected as shown below:

Column 6,
Line 4, “24e1 to 24e4,” should read -- 24a1 to 24a4, --.

Column 7,
Line 1, “becomes” should read -- become --.

Column 3,
Line 18, “existed)” should read -- present). --.
Lines 21 and 59, “guessed” should read -- detected --.
Line 57, “guesses” should read -- detected --.

Column 9,
Lines 55 and 65, “(alternate” should read -- alternating --.

Column 10,
Line 5, “21a” should read -- 21e --.
Line 25, “and, since the detecting member 20A and the” should be deleted.
Line 26 should be deleted.
Line 27, “can be cancelled,” should be deleted.
Line 53, “3OB5” should read -- 30B5 --.

Column 11,
Line 66, “Contacts” should read -- contacts --.

Column 12,
Line 54, “configuration” should read -- configurations --.
Line 60, “are” should read -- is --.

Column 13,
Line 37, “the lower” should read -- as the lower the --.

Column 14,
Line 24, “is decreased up to the” should read -- has decreased to such an --.
Line 43, “can” should read -- can be --.

UNITED STATES PATENT AND TRADEMARK OFFICE

CERTIFICATE OF CORRECTION

PATENT NO. : 6,415,111 B1
DATED : July 2, 2002
INVENTOR(S) : Akira Higeta

It is certified that error appears in the above-identified patent and that said Letters Patent is hereby corrected as shown below:

Column 15,
Line 40, "Of" should read -- of --.

Signed and Sealed this

Eleventh Day of March, 2003

JAMES E. ROGAN
*Director of the United States Patent and Trademark Office*